US007456592B2

(12) United States Patent
Yoo et al.

(10) Patent No.: US 7,456,592 B2
(45) Date of Patent: Nov. 25, 2008

(54) APPARATUS AND METHOD FOR CONTROLLING OPERATION OF RECIPROCATING COMPRESSOR

(75) Inventors: Jae-Yoo Yoo, Gyeonggi-Do (KR); Chel-Woong Lee, Seoul (KR); Ji-Won Sung, Seoul (KR)

(73) Assignee: LG Electronics Inc., Seoul (KR)

( * ) Notice: Subject to any disclaimer, the term of this patent is extended or adjusted under 35 U.S.C. 154(b) by 603 days.

(21) Appl. No.: 10/944,828

(22) Filed: Sep. 21, 2004

(65) Prior Publication Data

US 2005/0137722 A1 Jun. 23, 2005

(30) Foreign Application Priority Data

Dec. 17, 2003 (KR) ..... 10-2003-0092690
Dec. 17, 2003 (KR) ..... 10-2003-0092709
Dec. 17, 2003 (KR) ..... 10-2003-0092710
Feb. 20, 2004 (KR) ..... 10-2004-0011484

(51) Int. Cl.
*H02P 1/00* (2006.01)
*H02K 33/16* (2006.01)

(52) U.S. Cl. ..... 318/119; 318/127; 318/135; 318/632; 417/42.1; 417/44.1; 417/417

(58) Field of Classification Search ..... 318/135, 318/119; 417/44, 1, 417, 416, 44.11
See application file for complete search history.

(56) References Cited

U.S. PATENT DOCUMENTS 5,342,176 A * 8/1994 Redlich ..... 417/212
5,857,349 A * 1/1999 Hamaoka et al. ..... 62/228.4
6,014,004 A * 1/2000 Hamaoka et al. ..... 318/778
6,084,320 A * 7/2000 Morita et al. ..... 310/12
6,153,951 A * 11/2000 Morita et al. ..... 310/12
6,203,292 B1 * 3/2001 Morita et al. ..... 417/417
6,354,818 B2 * 3/2002 Morita et al. ..... 417/419
6,530,756 B2 * 3/2003 Morita et al. ..... 417/417
6,537,034 B2 * 3/2003 Park et al. ..... 417/44.1
6,554,577 B2 * 4/2003 Park et al. ..... 417/44.1
6,623,246 B2 * 9/2003 Hwang et al. ..... 417/44.1
6,632,076 B2 * 10/2003 Morita et al. ..... 417/417
6,682,310 B2 * 1/2004 Yoo et al. ..... 417/42
6,779,982 B2 * 8/2004 Heo ..... 417/44.11

(Continued)

FOREIGN PATENT DOCUMENTS

DE 101 47 610 A1 6/2002

(Continued)

*Primary Examiner*—Paul Ip
(74) *Attorney, Agent, or Firm*—Birch, Stewart, Kolasch & Birch, LLP

(57) ABSTRACT

An apparatus and method for controlling operations of a reciprocating compressor are disclosed. The apparatus includes a compressor control factor detecting unit for detecting a compressor control factor to detect a stroke value corresponding to a point where TDC (Top Dead Center)≈0 on the basis of a stroke estimate value of a reciprocating compressor and values of a current and a voltage applied to a motor of the reciprocating compressor; a stroke reference value determining unit for determining a stroke reference value on the basis of the detected compressor control factor; and a controller for varying a voltage applied to the reciprocating compressor according to the determined stroke reference value.

24 Claims, 12 Drawing Sheets

U.S. PATENT DOCUMENTS 6,811,380 B2 * 11/2004 Kim ..... 417/44.1
6,812,597 B2 * 11/2004 McGill et al. ..... 310/12
6,954,040 B2 * 10/2005 McGill et al. ..... 318/127
7,245,101 B2 * 7/2007 Dadd ..... 318/561
7,271,563 B2 * 9/2007 Yoo et al. ..... 318/632
7,285,878 B2 * 10/2007 McGill et al. ..... 310/12
7,341,432 B2 * 3/2008 Sung et al. ..... 417/44.1
7,352,142 B2 * 4/2008 Kim et al. ..... 318/135
2001/0002977 A1 * 6/2001 Morita et al. ..... 417/417
2002/0051710 A1 * 5/2002 Yoo et al. ..... 417/44.11
2002/0061254 A1 * 5/2002 Morita et al. ..... 417/417
2002/0062652 A1 * 5/2002 Hwang et al. ..... 62/228.3
2002/0064462 A1 * 5/2002 Park et al. ..... 417/44.1
2002/0064463 A1 * 5/2002 Park et al. ..... 417/44.1
2002/0064464 A1 * 5/2002 Hwang et al. ..... 417/44.11
2003/0026701 A1 * 2/2003 Yoo et al. ..... 417/42
2003/0026716 A1 * 2/2003 Morita et al. ..... 417/417
2003/0173834 A1 * 9/2003 McGill et al. ..... 310/12
2004/0119434 A1 * 6/2004 Dadd ..... 318/490
2004/0239266 A1 * 12/2004 Lee et al. ..... 318/119
2005/0008511 A1 * 1/2005 Kim ..... 417/416
2005/0069417 A1 * 3/2005 Kim ..... 417/1
2005/0111987 A1 * 5/2005 Yoo et al. ..... 417/44.11
2005/0152794 A1 * 7/2005 Kim ..... 417/417
2006/0228224 A1 * 10/2006 Hong et al. ..... 417/44.1
2007/0098566 A1 * 5/2007 Heo ..... 417/44.1
2007/0241697 A1 * 10/2007 Sung et al. ..... 318/135
2007/0241698 A1 * 10/2007 Sung et al. ..... 318/135

FOREIGN PATENT DOCUMENTS

DE 102 24 422 A1 2/2003
DE 102 26 491 A1 2/2003

* cited by examiner

APPARATUS AND METHOD FOR CONTROLLING OPERATION OF RECIPROCATING COMPRESSOR

This Non-provisional application claims priority under 35 U.S.C. §119(a) on Patent Application No(s). 10-2003-0092690; 10-2003-0092709; 10-2003-0092710; 10-2004-0011484 filed in Korea, Republic of on Dec. 17, 2003; Dec. 17, 2003; Dec. 17, 2003; and Feb. 20, 2004 respectively, the entire contents of which are hereby incorporated by reference.

BACKGROUND OF THE INVENTION

1. Field of the Invention

The present invention relates to a reciprocating compressor, and more particularly, to an apparatus and method for controlling operations of a reciprocating compressor.

2. Description of the Background Art

In general, a reciprocating compressor compresses a refrigerant circulating at the interior of a cooling unit to a high temperature and high pressure as a piston moves linearly and reciprocally inside a cylinder. The reciprocating compressor can be divided into a recipro type and a linear type depending on how the piston is driven.

In the recipro type reciprocating compressor,. a crank shaft is coupled to a rotating motor and a piston is coupled to the crank shaft, whereby the piston is linearly and reciprocally moved by using a rotational force of the rotating motor.

In the linear type reciprocating compressor, the piston is directly connected to a linear motor, whereby the piston is linearly and reciprocally moved by using the linear motion of the linear motor.

Since the linear type reciprocating compressor does not need the crank shaft for converting the rotational motion to the linear motion, it has a relatively less frictional loss and thus, high compression efficiency compared to a general compressor.

In addition, the linear type reciprocating compressor can control a compression ratio by controlling a voltage applied to a motor, it can control a freezing capacity of a cooling unit.

An apparatus for controlling operations of the reciprocating compressor will now be described with reference to FIG. 1.

FIG. 1 is a block diagram showing the construction of an apparatus for controlling operations of the conventional reciprocating compressor.

As shown in FIG. 1, the apparatus for controlling operations of the reciprocating compressor includes: a voltage detector 15 for detecting a voltage applied to a motor of the compressor; a current detector 14 for detecting a current applied to the motor of the compressor; a stroke estimator 16 for estimating a stroke on the basis of the detected current, the detected voltage and parameters for the motor; a comparator 11 for comparing the stroke estimate value with a stroke reference value and outputting a difference signal according to the comparison result; and a controller 12 for controlling a stroke of the motor by varying a voltage applied to the motor on the basis of the outputted difference signal.

A method for controlling operations of the reciprocating compressor in accordance with the conventional art will now be described with reference to FIG. 2.

FIG. 2 is a flow chart of the method for controlling operations of the reciprocating compressor in accordance with the conventional art.

As shown in FIG. 2, the method for controlling operations of the reciprocating compressor includes: detecting values of voltage and current applied to the motor of the compressor (step S21); calculating an stroke estimate value on the basis of the detected voltage value, the detected current value and motor parameters (step S22); comparing the calculated stroke estimate value and a stroke reference value (step S23); reducing a voltage applied to the motor if the stroke estimate value is greater than the stroke reference value; and increasing a voltage applied to the motor if the stroke estimate value is smaller than the stroke reference value (step S25).

The method for controlling operations of the reciprocating compressor will be described in detail as follows.

First, the voltage detector 15 detects a value of a voltage applied to the motor of the compressor at every predetermined period, and outputs the detected voltage value to the stroke estimator 16. The current detector 14 detects a value of a current applied to the motor of the compressor and outputs the detected current value to the stroke estimator 16 (step S21).

The stroke estimator 16 applies the detected current value, the detected voltage value and the motor parameters (e.g., a resistance or an inductance of the motor) to equation (1) shown below, to calculate a stroke estimate value, and output the calculated stroke estimate value to the comparator 11 (step S22).

$$x = \frac{1}{\alpha}\int [V_M - Ri - L\dot{i}]dt \tag{1}$$

Wherein, $\alpha$ is a motor constant, $V_M$ is a voltage of the motor, 'R' is a resistance of the motor, 'L' is an inductance of the motor, and 'i' is a current of the motor.

The comparator 11 compares the outputted stroke estimate value with the stroke reference value, generates a difference signal according to comparison, and outputs the generated difference signal to the controller 12 (step S23).

The controller 12 controls the stroke of the compressor by varying the voltage applied to the motor on the basis of the inputted difference signal. In this case, if the stroke estimate value is greater than the stroke reference value, the controller reduces the voltage applied to the motor (step S24). If the stroke estimate value is smaller than the stroke reference value, the controller 12 increases the voltage applied to the motor (step S25).

In this manner, the apparatus for controlling operations of the conventional reciprocating compressor stably drives the compressor by controlling the stroke uniformly by varying the voltage applied to the motor.

However, the conventional apparatus for controlling operations of the reciprocating compressor has the following problem.

That is, since the stroke of the compressor is estimated on the basis of the motor parameters such as the motor constant, the motor resistance, the motor inductance and motor current, deflections of the motor parameters causes an error in the estimated stroke of the compressor.

SUMMARY OF THE INVENTION

Therefore, an object of the present invention is to provide an apparatus and method for controlling operations of a reciprocating compressor capable of precisely controlling a stroke of a compressor by correcting a stroke deflection generated due to deflections of motor parameters on the basis of a stroke value corresponding to a point where TDC (Top Dead Center) ≈0.

To achieve these and other advantages and in accordance with the purpose of the present invention, as embodied and broadly described herein, there is provided an apparatus for controlling operations of a reciprocating compressor including: a compressor control factor detecting unit for detecting a compressor control factor to detect a stroke value corresponding to a point where TDC (Top Dead Center)≈0 on the basis of an stroke estimate value of a reciprocating compressor and values of a current and a voltage applied to a motor of the reciprocating compressor; a stroke reference value determining unit for determining a stroke reference value on the basis of the detected compressor control factor; and a controller for varying a voltage applied to the reciprocating compressor according to the determined stroke reference value.

To achieve the above objects, there is also provided a method for controlling operations of a reciprocating compressor including: detecting a compressor control factor to detect a stroke value corresponding to a point where TDC (Top Dead Center)≈0 on the basis of an stroke estimate value of a reciprocating compressor and values of a current and a voltage applied to the motor of the reciprocating compressor; determining a stroke reference value on the basis of the detected compressor control factor; and varying a voltage applied to the reciprocating compressor according to the determined stroke reference value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An apparatus and method for controlling operations of a reciprocating compressor, which are capable of precisely controlling a stroke of a compressor by correcting a stroke deflection generated due to deflection of motor parameters on the basis of a stroke value corresponding to a point where TDC (Top Dead Center)≈0, in accordance with preferred embodiments of the present invention will now be described. Herein, the point where TDC (Top Dead Center)≈0 means that a space corresponding to a top clearance volume of a piston in the compressor is substantially '0'.

Figure 1:
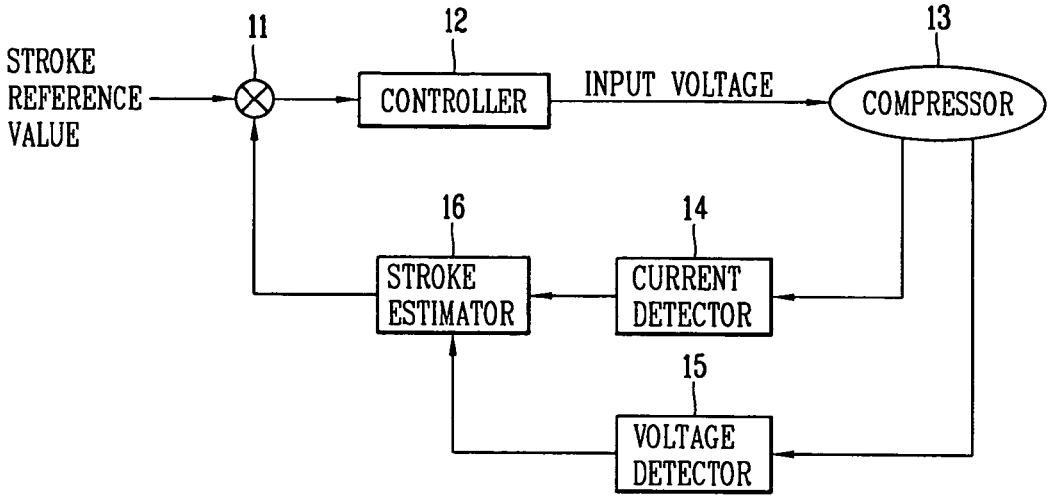
FIG. 1 CONVENTIONAL ART
FIG. 1 is a block diagram showing an apparatus for controlling operations of a reciprocating compressor in accordance with a conventional art.
Figure 2:
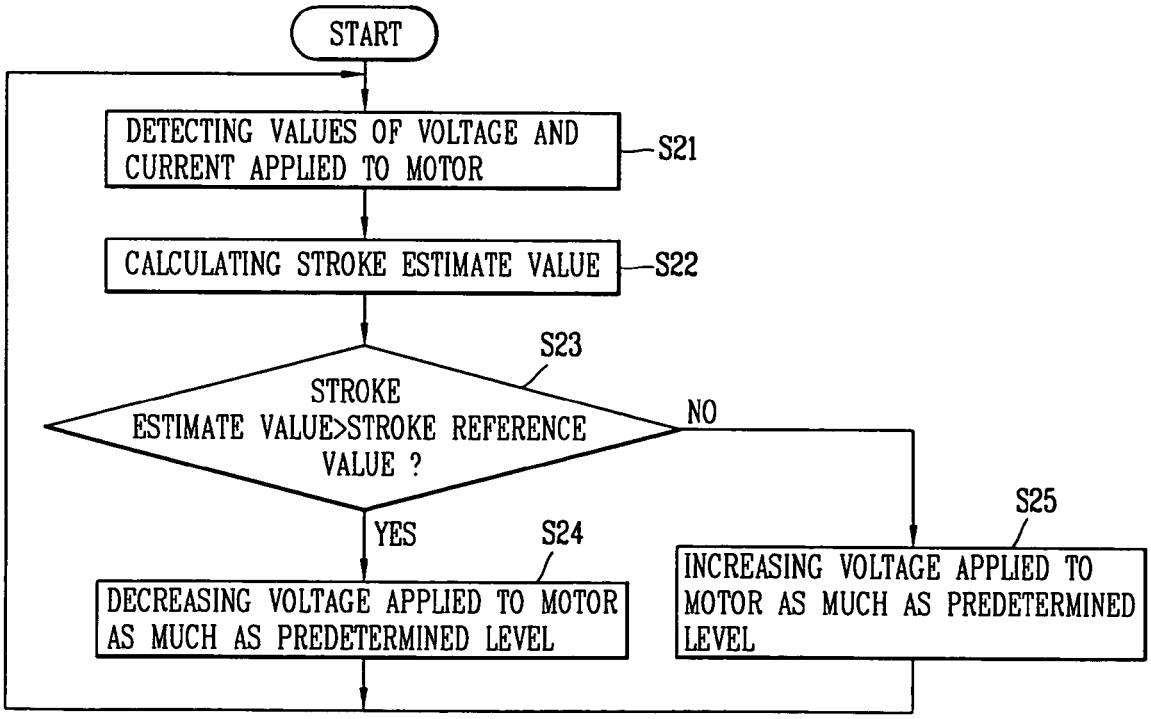
FIG. 2 CONVENTIONAL ART
FIG. 2 is a flow chart of a method for controlling operations of the reciprocating compressors in accordance with the conventional art.
Figure 3:
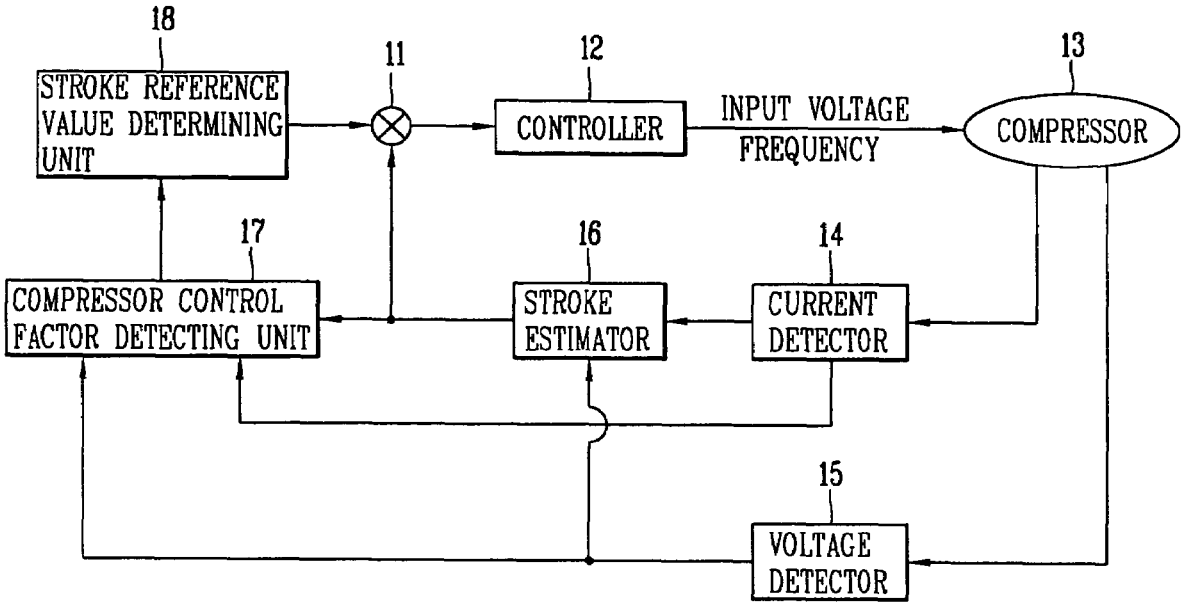
FIG. 3 is a block diagram showing an apparatus for controlling operations of a reciprocating compressor in accordance with the present invention.

FIG. 3 is a block diagram showing an apparatus for controlling operations of a reciprocating compressor in accordance with the present invention.

As shown in FIG. 3, the apparatus for controlling operations of a reciprocating compressor in accordance with the present invention includes: a current detector 14 for detecting a value of a current applied to a motor of a compressor; a voltage detector 15 for detecting a value of a voltage applied to the motor of the compressor; a stroke estimator 16 for calculating an stroke estimate value on the basis of the detected current and voltage values; a compressor control factor detecting unit 17 for detecting a compressor control factor to detect a stroke value corresponding to a point where TDC (Top Dead Center)≈0 on the basis of the detected voltage and current values and the calculated stroke estimate value; a stroke reference value determining unit 18 for determining a stroke reference value on the basis of the detected compressor control factor; a comparator 11 for comparing the determined stroke reference value and the calculated stroke estimate value, and outputting a difference value according to the comparison result; and a controller 12 for varying a voltage applied to the compressor on the basis of the outputted difference value.

A method for controlling operations of the reciprocating compressor constructed as described above will now be explained with reference to FIG. 4.

Figure 4:
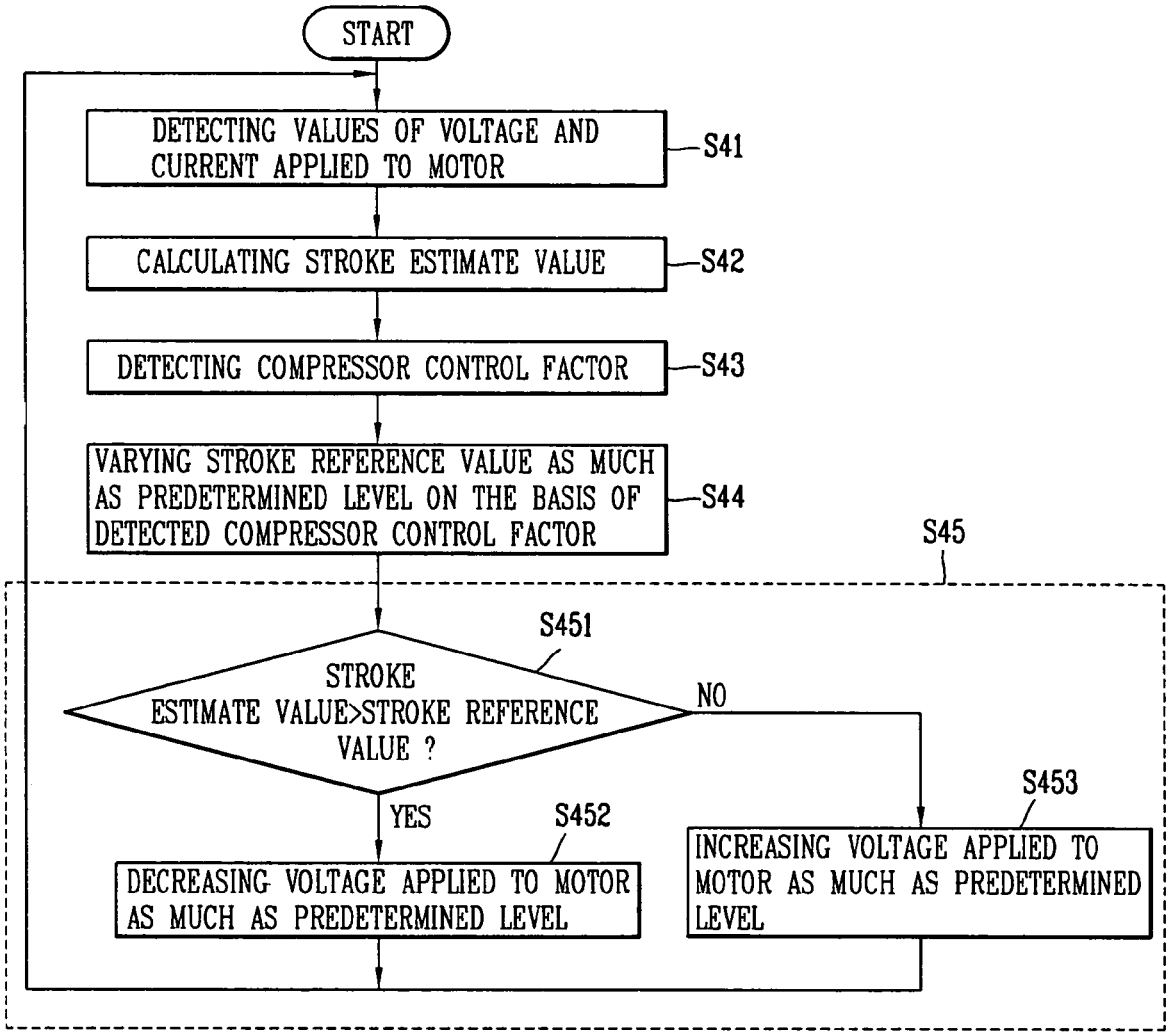
FIG. 4 is a flow chart of a method for controlling operations of the reciprocating compressors in accordance with the present invention.

FIG. 4 is a flow chart of a method for controlling operations of the reciprocating compressors in accordance with the present invention;

As shown in FIG. 4, a method for controlling operations of the reciprocating compressor in accordance with the present invention includes: detecting values of a current and a voltage applied to the motor of the compressor (step S41); calculating an stroke estimate value on the basis of the detected current and voltage values (step S42); detecting a compressor control factor to detect a stroke value corresponding to a point where TDC (Top Dead Center)≈0 on the basis of the detected current and voltage values and the calculated stroke estimate value (step S43); determining a stroke reference value on the basis of the detected compressor control factor (step S44); and varying a voltage applied to the compressor on the basis of the determined stroke reference value and the calculated stroke estimate value (step S45).

The method for controlling operations of the reciprocating compressor will now be described in detail.

First, the current detector 14 detects a value of a current applied to the motor of the compressor at every predetermined period, and the voltage detector 15 detects a value of a voltage applied to the motor of the compressor (step S41).

The stroke estimator 16 calculates a stroke estimate value of the compressor on the basis of the detected current and voltage values (step S42).

The compressor control factor detecting unit 17 detects a compressor control factor for detecting a stroke value corresponding to the point where TDC (Top Dead Center)≈0 on the basis of the detected current and voltage values and the calculated stroke estimate value (step S43). Herein, preferably, the compressor control factor can be a stroke determining constant of the compressor, a gas spring constant of the compressor, a damping coefficient of the compressor and power values of the compressor.

The process of detecting the stroke value corresponding to the point where TDC (Top Dead Center)≈0 through the compressor control factor will be described as follows.

The stroke reference value determining unit 18 determines the stroke reference value on the basis of the detected compressor control factor and applies the determined stroke reference value to the comparator 11. Namely, the stroke reference value determining unit 18 determines a stroke reference value of a current period varied as much as a predetermined value on the basis of the compressor control factor as the stroke reference value (step S44).

The comparator 11 compares the determined stroke reference value with the calculated stroke estimate value (step S451) and outputs a difference value according to the comparison to the controller 12, based on which the controller 12 can vary the stroke of the compressor.

Namely, if the determined stroke reference value is greater than the calculated stroke estimate value, the controller 12 increases a voltage applied to the motor of the compressor as much as a predetermined level (step S452). If the determined stroke reference value is smaller than the calculated stroke estimate value, the controller 12 reduces the voltage applied to the motor of the compressor as much as a predetermined level (step S453).

The first to fourth embodiments of the apparatus and method for controlling operations of the reciprocating compressor are implemented by applying a point of inflection of a stroke determining constant, a gas spring constant, a damping coefficient and power values as compressor control factors for detecting the stroke value corresponding to the point where TDC (Top Dead Center)≈0.

The process of detecting the stroke value corresponding to the point where TDC (Top Dead Center)≈0 in accordance with each embodiment of the present invention will now be described.

Figure 5:
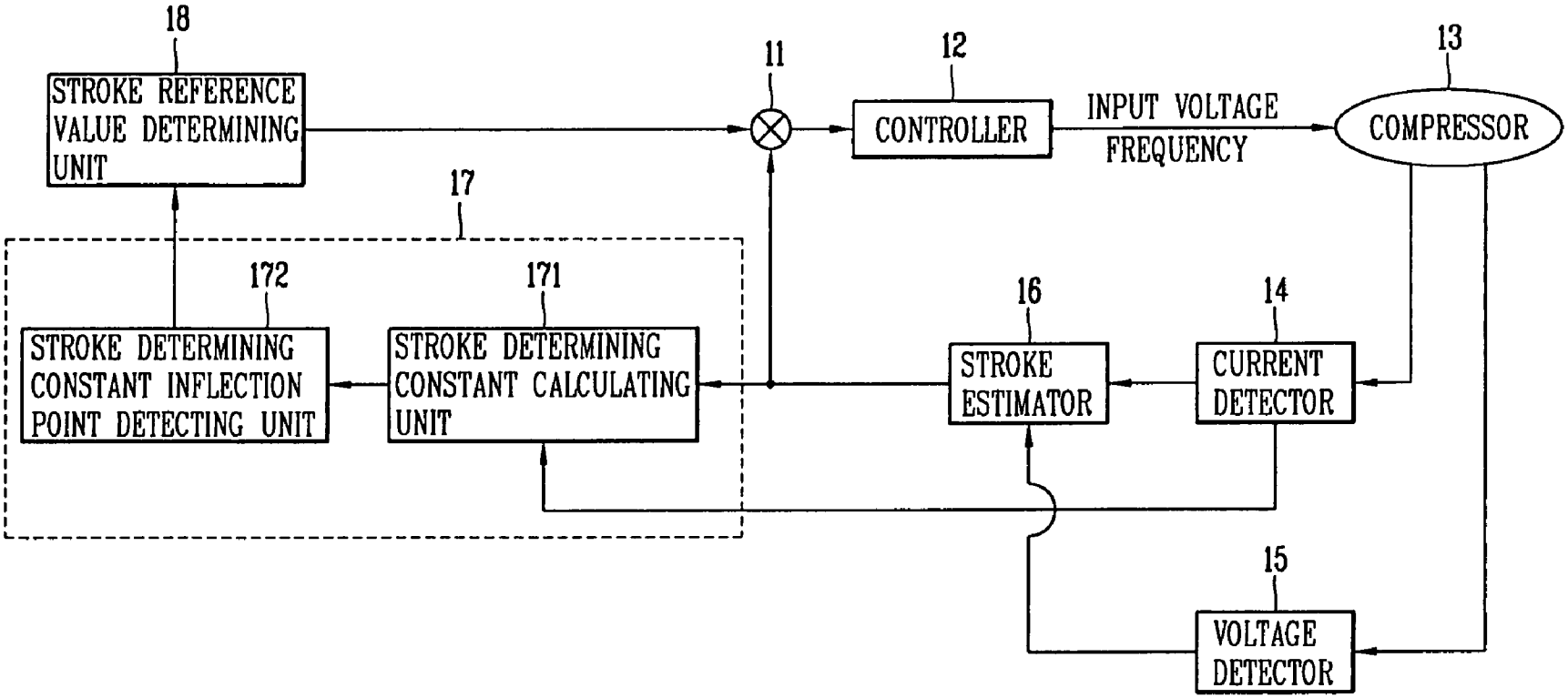
FIG. 5 is a block diagram showing an apparatus for controlling operations of a reciprocating compressor in accordance with a first embodiment of the present invention.

FIG. 5 is a block diagram showing an apparatus for controlling operations of a reciprocating compressor in accordance with a first embodiment of the present invention.

As shown in FIG. 5, an apparatus for controlling operations of a reciprocating compressor in accordance with the first embodiment of the present invention includes: a stroke determining constant calculating unit 171 for calculating a stroke determining constant on the basis of the stroke estimate value calculated in the stroke estimator 16 and the current detected in the current detector 14; a stroke determining constant inflection point detecting unit 172 for detecting a point of inflection of a stroke determining constant on the basis of the calculated stroke determining constant and a stroke determining constant of a previous period; and a stroke reference value determining unit 18 for determining a stroke reference value on the basis of the inflection point of the detected stroke determining constant.

The method for controlling operations of the reciprocating compressor in accordance with the first embodiment of the present invention will now be described with reference to FIG. 6.

Figure 6:
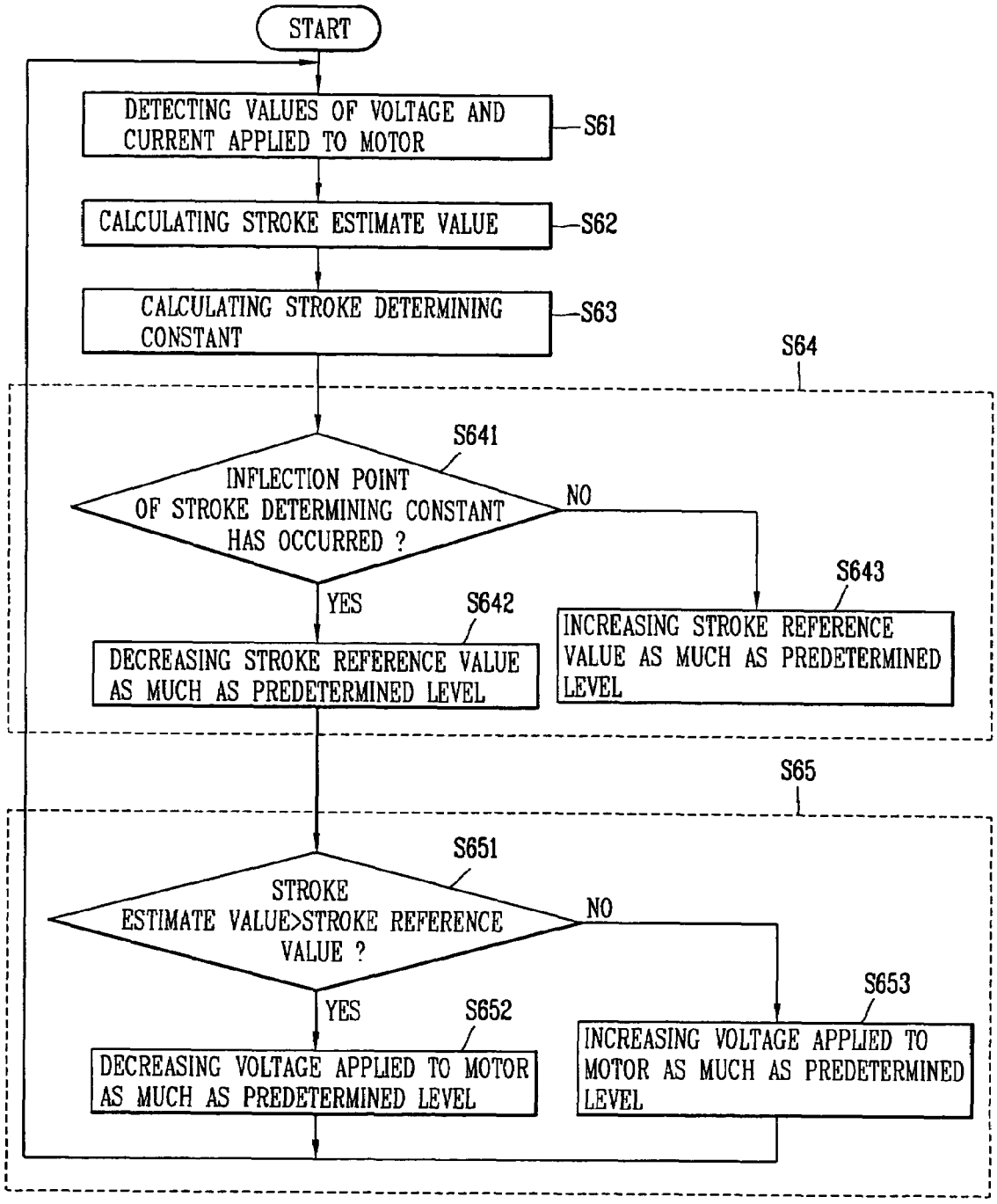
FIG. 6 is a flow chart of a method for controlling operations of the reciprocating compressors in accordance with the first embodiment of the present invention.

As shown in FIG. 6, the method for controlling operations of the reciprocating compressor in accordance with the first embodiment of the present invention includes: calculating a stroke determining constant on the basis of a value of a current applied to the motor of the compressor and an stroke estimate value of the compressor (step S63); determining whether an inflection point of the stroke determining constant has been generated on the basis of the calculated stroke determining constant and a stroke determining constant of a previous period (step S641); and determining a current operation frequency reduced as much as a predetermined value as a stroke reference value if the inflection point of the stroke determining constant has been generated (step S642).

In the step S641, if no inflection point of the stroke determining constant has been generated, the current operation frequency increased as much as the predetermined value is determined as a stroke reference value.

In the method for controlling operations of the reciprocating compressor in accordance with the first embodiment of the present invention, the step of determining the stroke reference value on the basis of the stroke determining constant will be described in detail as follows.

First, the stroke determining constant is defined as a value obtained by dividing the calculated stroke estimate value by the detected current value or a value obtained by dividing the detected current value by the calculated stroke estimate value. The stroke determining constant calculating unit 171 calculates the stroke determining constant by equation (2) shown below:

$$\left[\frac{X(jw)}{I(jw)}\right] = \frac{\alpha}{\sqrt{(k - mw^2)^2 + (wc)^2}} \tag{2}$$

Wherein, $\alpha$ is a motor constant, 'k' is a spring constant of the compressor, 'm' is a mass of the compressor, 'w' is an operation frequency of the compressor, and 'c' is a viscosity coefficient of the compressor.

Thereafter, the stroke determining constant inflection point detecting unit 172 detects an inflection point of the calculated stroke determining constant (step S641).

The principle of obtaining the inflection point of the stroke determining constant will now be described with reference to FIGS. 7A and 7B.

Figure 7A:
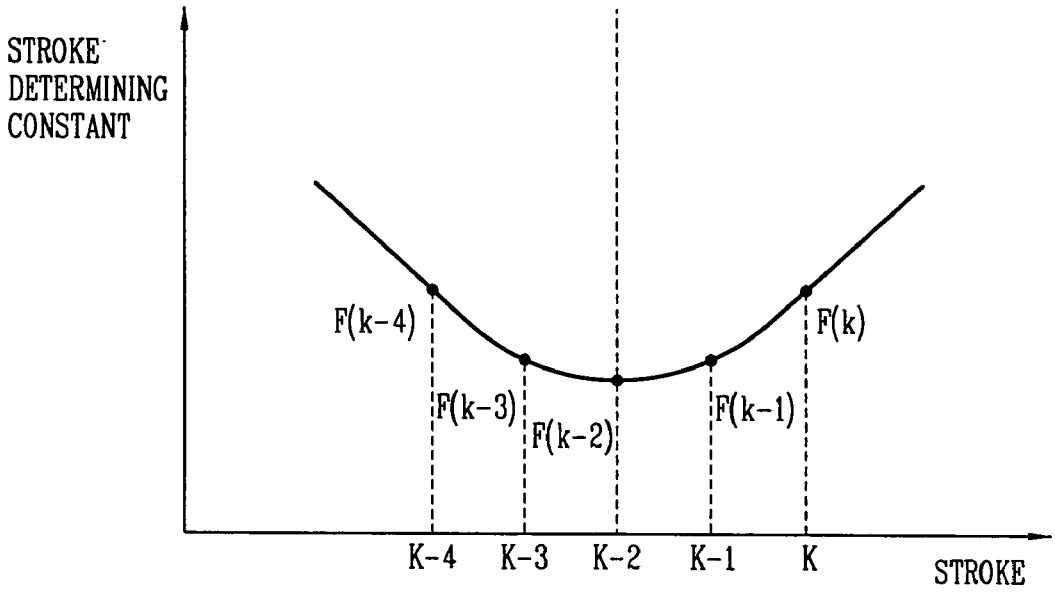
FIGS. 7A and 7B are graphs showing a principle for detecting an inflection point of a stroke determining constant in accordance with the first embodiment of the present invention.
Figure 7B:
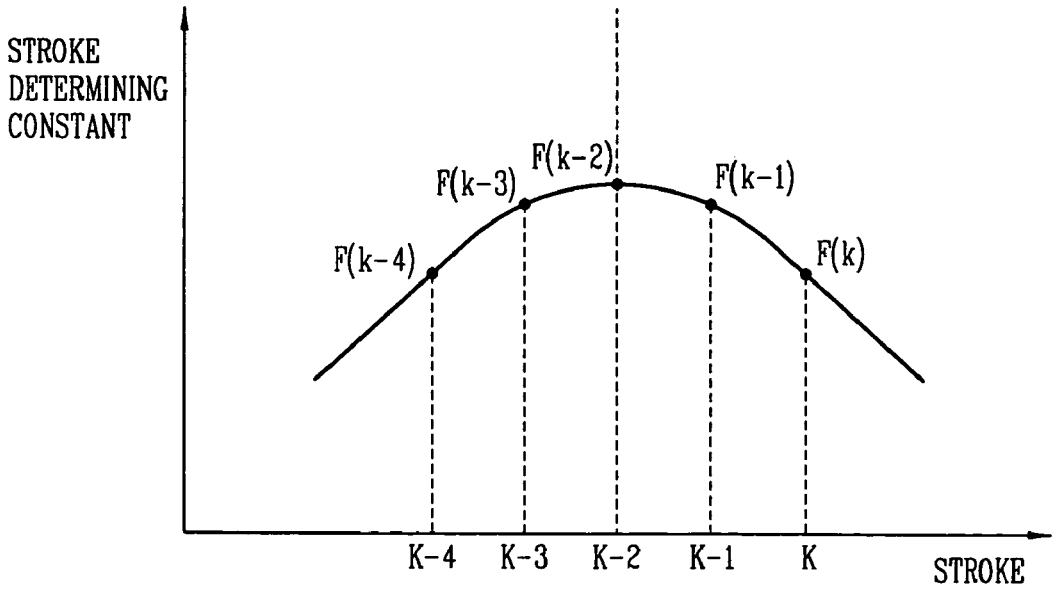

FIGS. 7A and 7B are graphs showing a principle for detecting an inflection point of a stroke determining constant in accordance with the first embodiment of the present invention.

The inflection point of the stroke determining constant means a point where a value of the stroke determining constant is changed from a descent interval to an ascent interval as shown in FIG. 7A, or a point where a value of the stroke determining constant is changed from the ascent interval to a descent interval as shown in FIG. 7B.

Accordingly, the stroke determining constant inflection point detecting unit 172 can determine whether an inflection point of the stroke determining constant has occurred by comparing the calculated stroke determining constant value and a stroke determining constant value of a previous period. Herein, the stroke value at the inflection point of the stroke determining constant is a stroke value corresponding to the point where a TDC≈0.

Accordingly, if the inflection point of the stroke determining constant has occurred, the stroke reference value determining unit 18 determines a predetermined value-reduced stroke reference value of the current period as a stroke reference value (step S642), and if the inflection point of the stroke determining constant does not occur, the stroke reference value determining unit 18 determines a predetermined value-increased stroke reference value of the current period as the stroke reference value (step S643).

The apparatus for controlling operation of the reciprocating compressor in accordance with the second embodiment of the present invention adopting the gas sprig constant as the compressor control factor will now be described.

Figure 8:
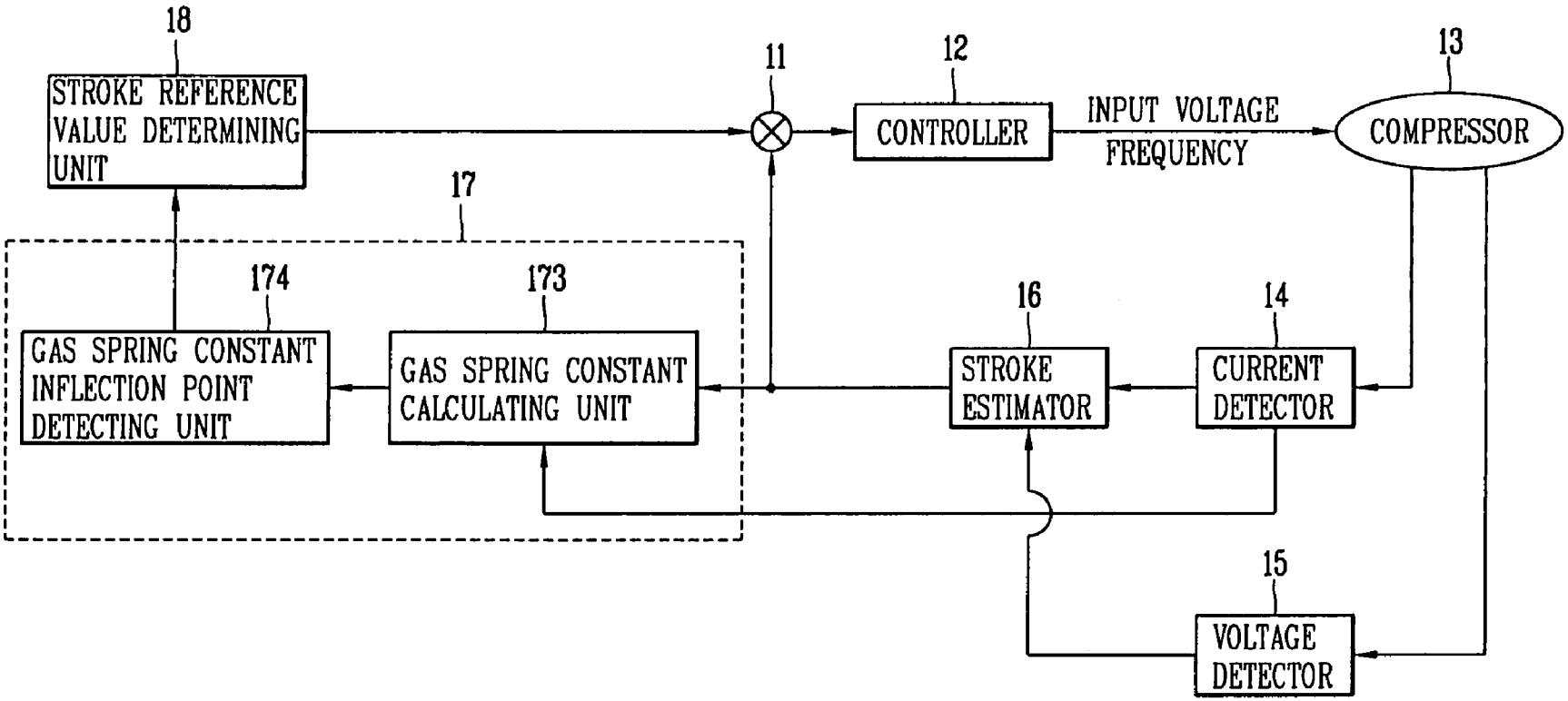
FIG. 8 is a block diagram showing an apparatus for controlling operations of a reciprocating compressor in accordance with a second embodiment of the present invention.

FIG. 8 is a block diagram showing an apparatus for controlling operations of a reciprocating compressor in accordance with a second embodiment of the present invention.

As shown in FIG. 8, the apparatus for controlling operations of a reciprocating compressor in accordance with the second embodiment of the present invention includes: a gas spring constant calculating unit 173 for calculating a gas spring constant on the basis of the stroke estimate value calculated in the stroke estimator 16 and the current detected in the current detector 14; a gas spring constant inflection point detecting unit 174 for detecting an inflection point of a gas spring constant on the basis of the calculated gas spring constant and a gas spring constant of a previous period; and a stroke reference value determining unit 18 for determining a stroke reference value on the basis of the inflection point of the detected stroke determining constant.

The method for controlling operations of the reciprocating compressor in accordance with the second embodiment of the present invention will now be described with reference to FIG. 9.

Figure 9:
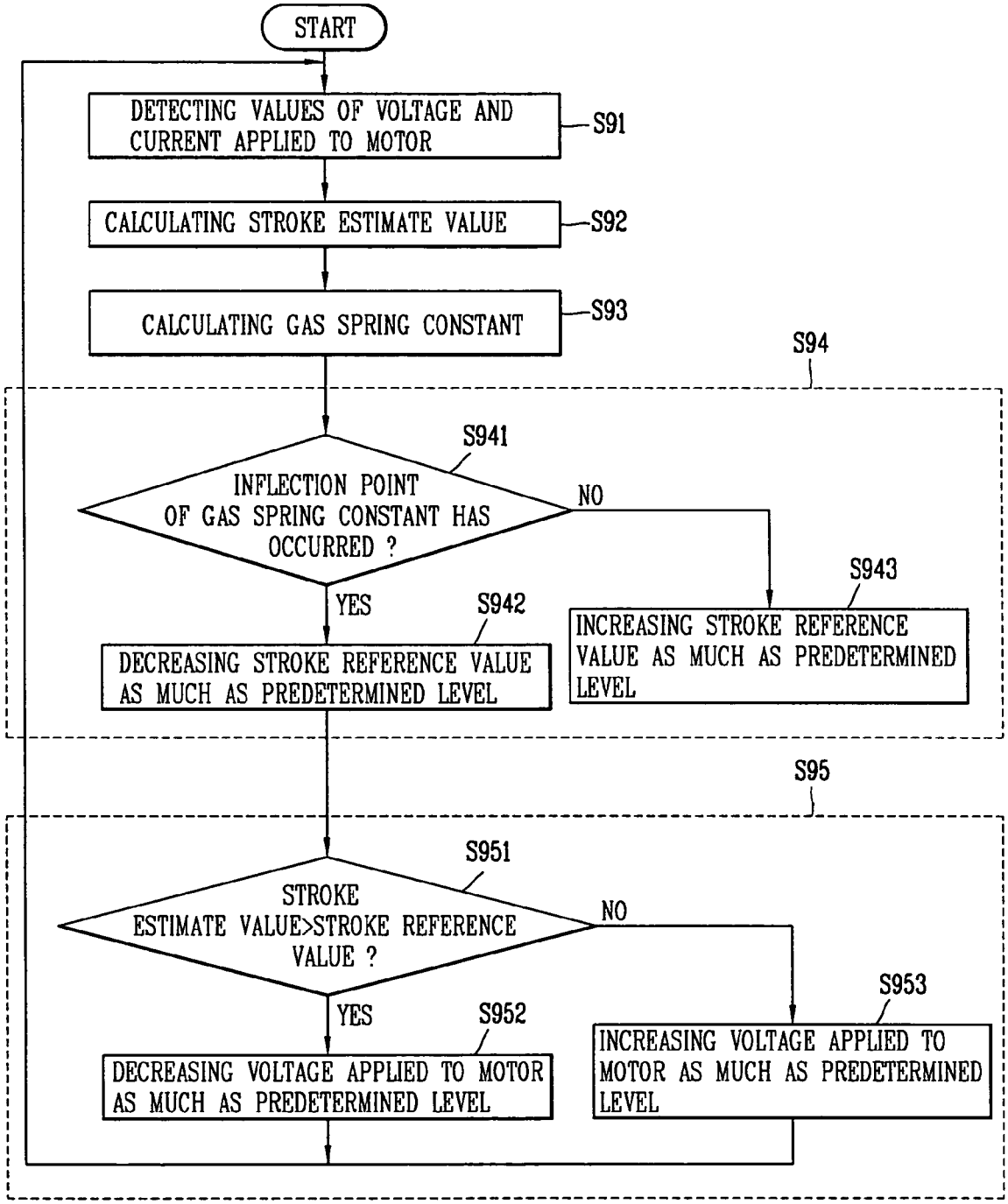
FIG. 9 is a flow chart of a method for controlling operations of the reciprocating compressors in accordance with the second embodiment of the present invention.

FIG. 9 is a flow chart of a method for controlling operations of the reciprocating compressors in accordance with the second embodiment of the present invention.

As shown in FIG. 9, the method for controlling operations of the reciprocating compressor in accordance with the present invention include: calculating a gas spring constant on the basis of the value of a current applied to the motor of the compressor and an stroke estimate value of the compressor (step S93); determining whether an inflection point of the gas spring constant has occurred on the basis of the calculated gas spring constant and a gas spring constant of a previous period (step S941); and determining a predetermined value-reduced current stroke reference value as a stroke reference value if an inflection point of the gas spring constant has occurred (step S942).

In the step S941, if no inflection point of the gas spring constant has occurred, a predetermined value-increased current stroke reference value is determined as the stroke reference value (step S943).

The gas spring constant adopted for the method for controlling operations of the reciprocating compressor in accordance with the second embodiment of the present invention will now be described through equation (3) shown below:

$$K_g = \alpha \times \left| \frac{I(jw)}{X(jw)} \right| \times \cos(\theta_{i,x}) + mw^2 - K_m \tag{3}$$

Wherein, $\alpha$ is a motor constant, $\theta$ is a potential difference between a current and a stroke, 'm' is a mass of the compressor, 'w' is an operation frequency of the compressor, and $K_m$ is a mechanical spring constant of the compressor.

The step of determining whether an inflection of the gas spring constant has occurred and varying the stroke reference value according to the determining result is the same as that in the first embodiment, descriptions on which are, thus, emitted.

An apparatus for controlling operations of the reciprocating compressor adopting the damping coefficient as the compressor control factor in accordance with a third embodiment of the present invention will now be described.

Figure 10:
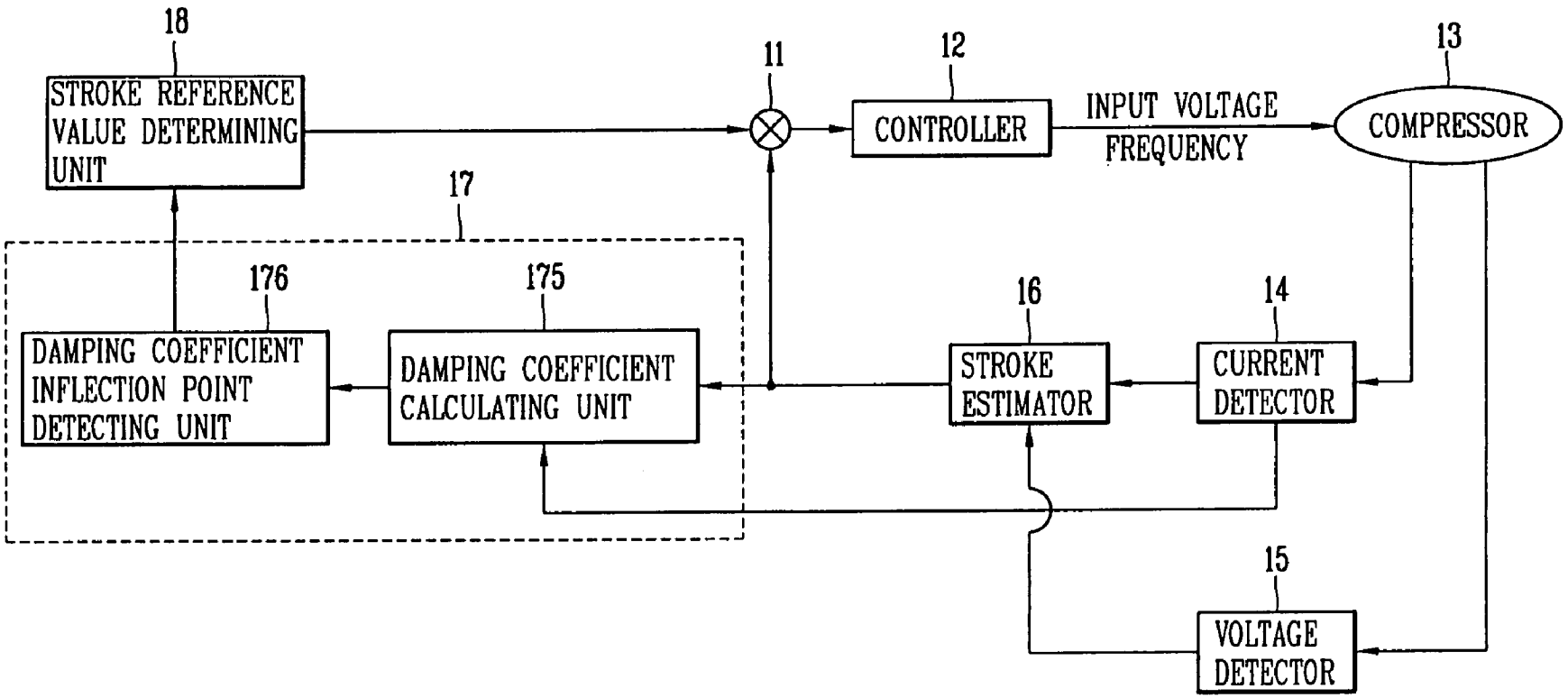
FIG. 10 is a block diagram showing an apparatus for controlling operations of a reciprocating compressor in accordance with a third embodiment of the present invention.

FIG. 10 is a block diagram showing an apparatus for controlling operations of a reciprocating compressor in accordance with a third embodiment of the present invention.

As shown in FIG. 10, the apparatus for controlling operations of the reciprocating compressor in accordance with the third embodiment of the present invention includes: a damping coefficient calculating unit 175 for calculating a damping coefficient on the basis of a stroke estimate value calculated in the stroke estimator 16 and a current detected in the current detector 14; an damping coefficient inflection point detecting unit 176 for detecting an inflection point of a damping coefficient on the basis of the calculated damping coefficient and a damping coefficient of a previous period; and a stroke reference value determining unit 18 for determining a stroke reference value on the basis of the detected inflection point of the damping coefficient.

A method for controlling operations of the reciprocating compressor in accordance with the third embodiment of the present invention will now be described with reference to FIG. 11.

Figure 11:
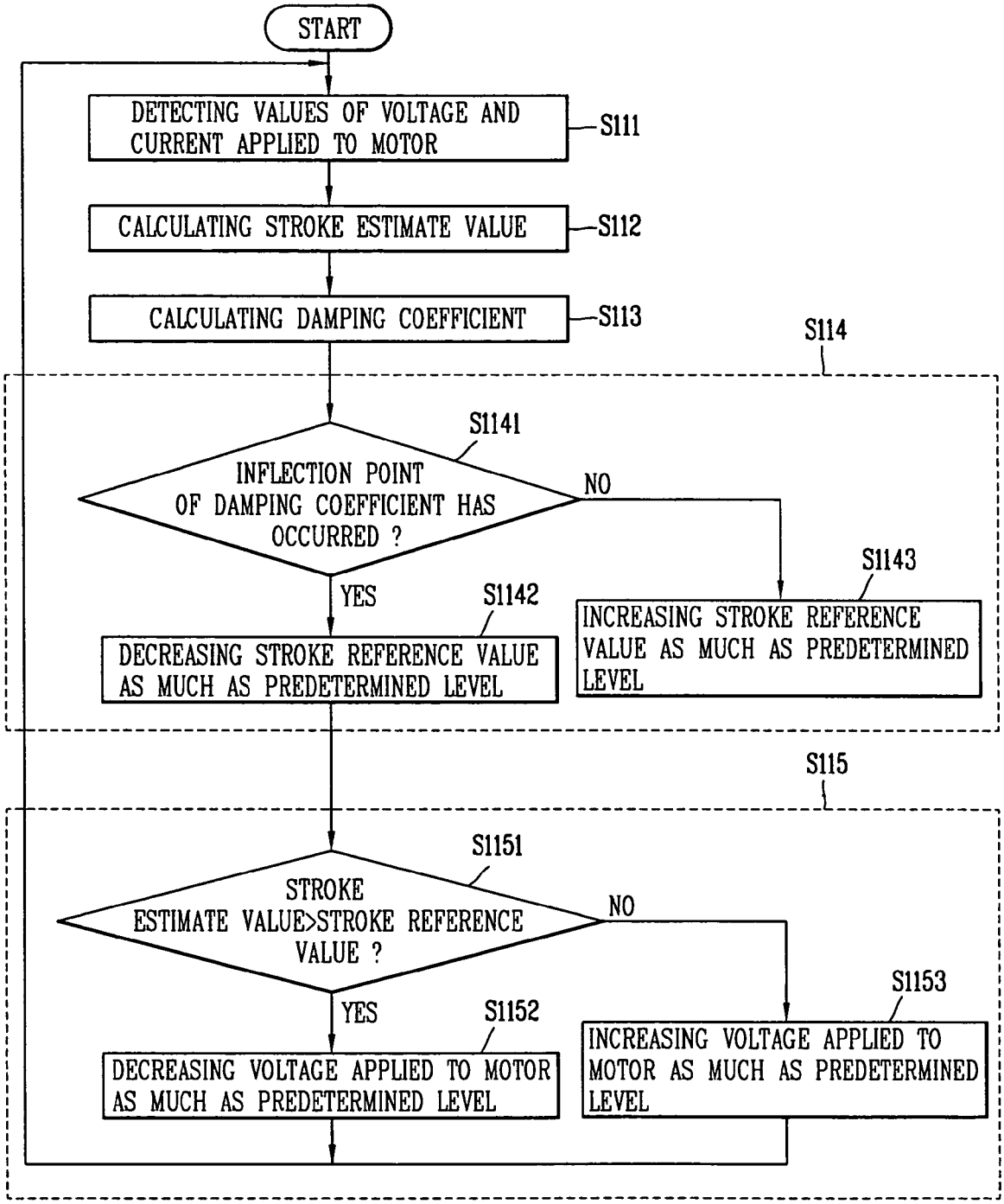
FIG. 11 is a flow chart of a method for controlling operations of the reciprocating compressors in accordance with the third embodiment of the present invention.

FIG. 11 is a flow chart of a method for controlling operations of the reciprocating compressors in accordance with the third embodiment of the present invention.

As shown in FIG. 11, the method for controlling operations of the reciprocating compressor includes: calculating a damping coefficient on the basis of a value of a current applied to the motor of the compressor and a stroke estimate value of the compressor (step S113); determining whether an inflection point of a damping coefficient has occurred on the basis of the calculated damping coefficient and a damping coefficient of a previous period (step S1141); and determining a predetermined value-reduced current stroke reference value as a stroke reference value if an inflection point of the damping coefficient has occurred (step 1142).

In the step S1141, if an inflection point of the damping coefficient has not occurred, a predetermined value-increased current stroke reference value as a stroke reference value (step S1143).

The damping coefficient adopted for the method for controlling operations of the reciprocating compressor in accordance with the third embodiment of the present invention is calculated by equation (4) shown below:

$$C = \frac{\alpha \times \left| \frac{I(jw)}{X(jw)} \right| \times \sin(\theta_{i,x})}{w} \quad (4)$$

Wherein, α is a motor constant, θ is a potential difference between a current and a stroke of the compressor, and 'w' is an operation frequency of the compressor.

The step of determining whether an inflection point of a damping coefficient has occurred and varying the stroke reference value according to the determining result is the same as in the first embodiment of the present invention, descriptions on which are thus omitted.

An apparatus for controlling operations of a reciprocating compressor adopting a power value as the compressor control factor in accordance with a fourth embodiment of the present.

Figure 12:
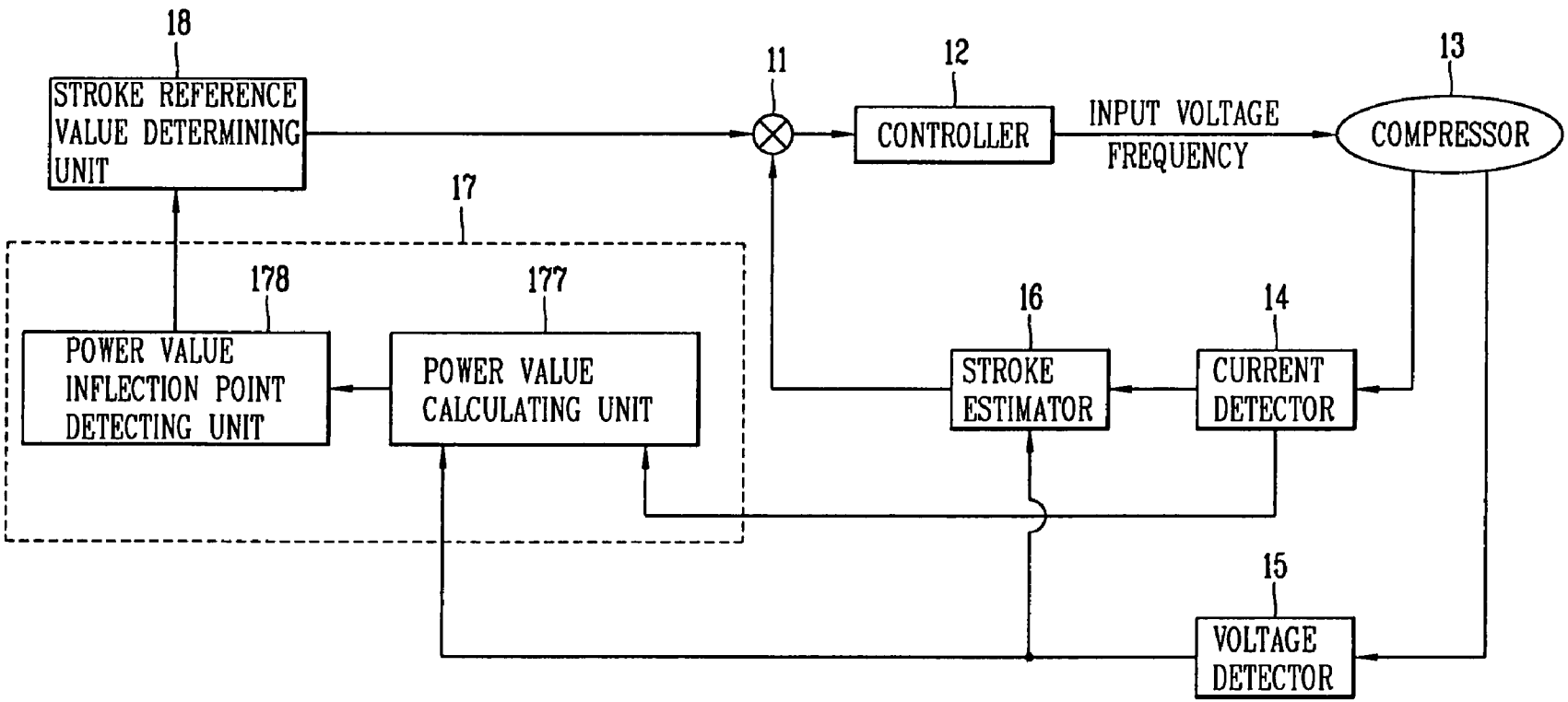
FIG. 12 is a block diagram showing an apparatus for controlling operations of a reciprocating compressor in accordance with a fourth embodiment of the present invention.

FIG. 12 is a block diagram showing an apparatus for controlling operations of a reciprocating compressor in accordance with a fourth embodiment of the present invention.

As shown in FIG. 12, the apparatus for controlling operations of the reciprocating compressor in accordance with the fourth embodiment of the present invention includes: a power value calculating unit 177 for calculating a power value on the basis of a voltage detected in the voltage detector 15 and a current detected in the current detector 14; a power value inflection point detecting unit 178 for detecting an inflection point of a power value on the basis of the calculated power value and a power value of a previous period; and a stroke reference value determining unit 18 for determining a stroke reference value on the basis of the inflection point of the detected power value.

A method for controlling operations of the reciprocating compressor in accordance with the fourth embodiment of the present invention will now be described with reference to FIG. 13.

Figure 13:
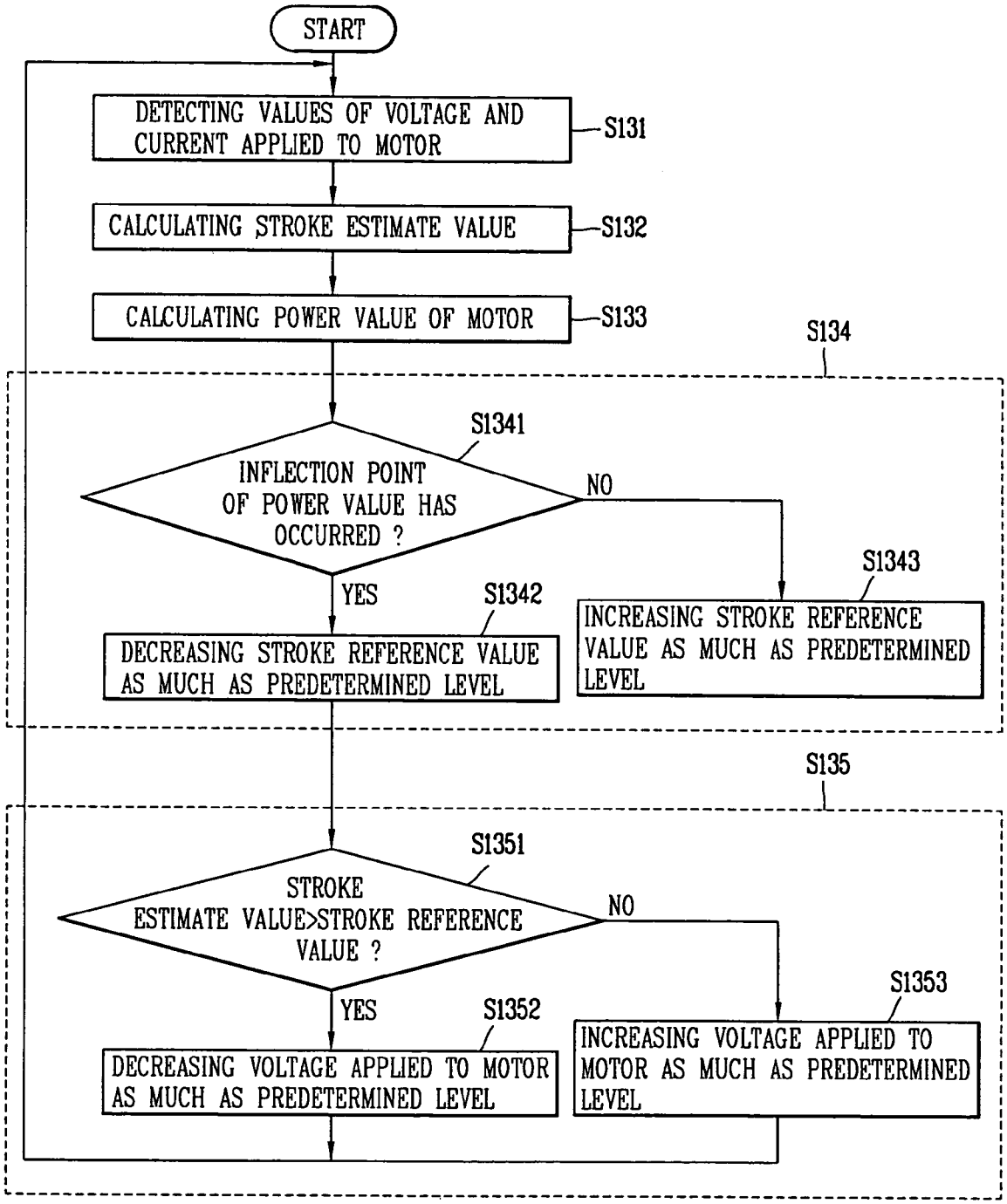
FIG. 13 is a flow chart of a method for controlling operations of the reciprocating compressors in accordance with the fourth embodiment of the present invention.

FIG. 13 is a flow chart of a method for controlling operations of the reciprocating compressors in accordance with the fourth embodiment of the present invention.

As shown in FIG. 13, the method for controlling operations of the reciprocating compressor in accordance with the fourth embodiment of the present invention includes: calculating a power value on the basis of values of a current and a voltage applied to the motor of the compressor (step S133); comparing the calculated power value with a power value of a previous period and determining whether an inflection point of a power value has occurred on the basis of the comparison result (step S1341); and determining a predetermined value-reduced current stroke reference value as a stroke reference value if an inflection point of the power value has occurred.

In the step S1341, if an inflection point of the power value has not occurred, a predetermined value-increased current stroke reference value is determined as a stroke reference value (step S1343).

The power value of the compressor adopted for the method for controlling operations of the reciprocating compressor in accordance with the fourth embodiment of the present invention means a value obtained by multiplying the values of the current and the voltage applied to the motor of the compressor.

The step of determining whether an inflection point of the power value and varying the stroke reference value according to the determining result is the same as in the first embodiment, descriptions on which are, thus, omitted.

As so far described, the apparatuses and methods for controlling operations of the reciprocating compressor in accordance with the first to fourth embodiments of the present invention have the following advantages.

That is, for example, since the stroke deflection generated due to deflections of motor parameters is corrected on the basis of the stroke value corresponding to the point where TDC (Top Dead Center)≈0, the stroke of the compressor can be precisely controlled.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling operations of a reciprocating compressor comprising:

a stroke estimator for calculating a stroke estimate value on the basis of values of a current and a voltage applied to a motor of the reciprocating compressor;

a compressor control factor detecting unit for detecting a compressor control factor to detect a stroke value corresponding to a point where TDC (Top Dead Center)≈0 on the basis of the calculated stroke estimate value of the reciprocating compressor and the values of the current and the voltage applied to the motor of the reciprocating compressor;

a stroke reference value determining unit for determining a stroke reference value on the basis of the detected compressor control factor; and a controller for varying a voltage applied to the reciprocating compressor according to a comparison result between the determined stroke reference value with the calculated stroke estimate value.

2. The apparatus of claim 1, wherein the compressor control factor is one of a stroke determining constant, a gas spring constant a damping coefficient and a power value.

3. The apparatus of claim 1, wherein the compressor control factor detecting unit comprises:

a stroke determining constant calculating unit for calculating a stroke determining constant on the basis of the stroke estimate value of the compressor and the value of the current applied to the motor of the compressor; and a stroke determining constant inflection point detecting unit for detecting an inflection point of the calculated stroke determining constant.

4. The apparatus of claim 3, wherein the stroke determining constant is one of a value obtained by dividing the stroke value of compressor by a value of the current applied to the motor of the compressor and a value obtained by dividing the value of the current applied to the motor of the compressor by the stroke value of the compressor.

5. The apparatus of claim 3, wherein when an inflection point of the stroke determining constant is detected, the stroke reference value determining unit determines a predetermined value-reduced stroke reference value of the current period as a stroke reference value, and when an inflection point of the stroke determining constant is not detected, the stroke reference value determining unit determines a predetermined value-increased stroke reference value of the current period as a stroke reference value.

6. The apparatus of claim 1, wherein the compressor control factor detecting unit comprises:

a gas spring constant calculating unit for calculating a gas spring constant on the basis of the stroke estimate value of the compressor and the value of the current applied to the motor of the compressor; and a gas spring constant inflection point detecting unit for detecting an inflection point of the calculated gas spring constant.

7. The apparatus of claim 6, wherein when an inflection point of the gas spring constant is detected, the stroke reference value determining unit determines a predetermined value-reduced stroke reference value of the current period as a stroke reference value, and when an inflection point of the gas spring constant is not detected, the stroke reference value determining unit determines a predetermined value-increased stroke reference value of the current period as a stroke reference value.

8. The apparatus of claim 1, wherein the compressor control factor detecting unit comprises:

a damping coefficient calculating unit for calculating a damping coefficient on the basis of the stroke estimate value of the compressor and the value of the current applied to the motor of the compressor; and a damping coefficient inflection point detecting unit for detecting an inflection point of the calculated damping coefficient.

9. The apparatus of claim 8, wherein when an inflection point of the damping coefficient is detected, the stroke reference value determining unit determines a predetermined value-reduced stroke reference value of the current period as a stroke reference value, and when an inflection point of the damping coefficient is not detected, the stroke reference value determining unit determines a predetermined value-increased stroke reference value of the current period as a stroke reference value.

10. The apparatus of claim 1, wherein the compressor control factor detecting unit comprises:

a power calculating unit for calculating a power value on the basis of the values of the current and voltage applied to the motor of the compressor; and a power inflection point detecting unit for detecting an inflection point of the calculated power value.

11. The apparatus of claim 10, wherein the power value is a value obtained by multiplying the values of the current and voltage applied to the motor of the compressor.

12. The apparatus of claim 10, wherein when an inflection point of the power value is detected, the stroke reference value determining unit determines a predetermined value-reduced stroke reference value of the current period as a stroke reference value, and when an inflection point of the gas spring constant is not detected, the stroke reference value determining unit determines a predetermined value-increased stroke reference value of the current period as a stroke reference value.

13. A method for controlling operations of a reciprocating compressor comprising:

calculating a stroke estimate value on the basis of values of a current and a voltage applied to a motor of the reciprocating compressor;

detecting a compressor control factor to detect a stroke value corresponding to a point where TDC To Dead Center)≈0 on the basis of the calculated stroke estimate value of the reciprocating compressor and the values of the current and the voltage applied to the motor of the reciprocating compressor;

determining a stroke reference value on the basis of the detected compressor control factor; and varying a voltage applied to the reciprocating compressor according to a comparison result between the determined stroke reference value with the calculated stroke estimate value.

14. The method of claim 13, wherein the compressor control factor is one of a stroke determining constant a gas spring constant, a damping coefficient and a power value.

15. The method of claim 13, wherein the step of detecting the compressor control factor comprises:

calculating a stroke determining constant on the basis of the stroke estimate value of the compressor and the value of the current applied to the motor of the compressor; and detecting an inflection point of the calculated stroke determining constant.

16. The method of claim 15, wherein the stroke determining constant is one of a value obtained by dividing the stroke value of compressor by a value of the current applied to the motor of the compressor and a value obtained by dividing the value of the current applied to the motor of the compressor by the stroke value of the compressor.

17. The method of claim 15, wherein, in the step of determining the stroke reference value, when an inflection point of the stroke determining constant is detected, a predetermined value-reduced stroke reference value of the current period is determined as a stroke reference value, and when an inflection point of the stroke determining constant is not detected, a predetermined value-increased stroke reference value of the current period is determined as a stroke reference value.

18. The method of claim 13, wherein, in the step of detecting the compressor control factor comprises:

calculating a gas spring constant on the basis of the stroke estimate value of the compressor and the value of the current applied to the motor of the compressor; and detecting an inflection point of the calculated gas spring constant.

19. The method of claim 18, wherein, in the step of determining the stroke reference value, when an inflection point of the gas spring constant is detected, a predetermined value-reduced stroke reference value of the current period is determined as a stroke reference value, and when an inflection point of the gas spring constant is not detected, a predetermined value-increased stroke reference value of the current period is determined as a stroke reference value.

20. The method of claim 13, wherein the step of detecting the compressor control factor comprises:

calculating a damping coefficient on the basis of the stroke estimate value of the compressor and the value of the current applied to the motor of the compressor; and detecting an inflection point of the calculated damping coefficient.

21. The method of claim 20, wherein, in the step of determining the stroke reference value, when an inflection point of the damping coefficient is detected, a predetermined value-reduced stroke reference value of the current period is determined as a stroke reference value, and when an inflection point of the damping coefficient is not detected, a predetermined value-increased stroke reference value of the current period is determined as a stroke reference value.

22. The method of claim 13, wherein the step of detecting the compressor control factor comprises:

calculating a power value on the basis of the values of the current and voltage applied to the motor of the compressor; and detecting an inflection point of the calculated power value.

23. The method of claim 22, wherein the power value is a value obtained by multiplying the values of the current and voltage applied to the motor of the compressor.

24. The method of claim 22, wherein, in the step of determining the stroke reference value, when an inflection point of the power value is detected, a predetermined value-reduced stroke reference value of the current period is determined as a stroke reference value, and when an inflection point of the gas spring constant is not detected, a predetermined value-increased stroke reference value of the current period is determined as a stroke reference value.

* * * * *